US005875516A

United States Patent [19]

Blue

[11] Patent Number: 5,875,516

[45] Date of Patent: Mar. 2, 1999

[54] ACCESSORY FOR A TOOTHBRUSH

[76] Inventor: John D. Blue, P.O. Box 1992, Tarpon Springs, Fla. 34688-1992

[21] Appl. No.: 798,696

[22] Filed: Feb. 12, 1997

[51] Int. Cl.[6] ..... A46B 17/00

[52] U.S. Cl. ..... 15/248.1; 15/167.1; 132/308; 248/688; D4/108; D4/113

[58] Field of Search ..... 15/143.1, 167.1, 15/184, 246, 248.1, 248.2; 132/308–311; 206/15.2, 15.3, 362.2, 362.3, 581; 248/110, 688; D4/108, 113

[56] References Cited

U.S. PATENT DOCUMENTS

| | | | |
|---|---|---|---|
| 569,936 | 10/1896 | Potter | 248/688 X |
| 851,550 | 4/1907 | Nevius | 15/248.1 |
| 860,527 | 7/1907 | Cochrane | 15/248.1 |
| 1,501,020 | 7/1924 | Small | 15/248.1 |
| 2,394,640 | 2/1946 | Singer | 15/248.1 |
| 3,921,649 | 11/1975 | Milbrath | 132/308 |
| 3,968,950 | 7/1976 | Gallo | 15/248.1 X |

FOREIGN PATENT DOCUMENTS

| | | | |
|---|---|---|---|
| 2310723 | 12/1976 | France | 15/248.1 |
| 2380754 | 9/1978 | France | 15/248.1 |

*Primary Examiner*—Mark Spisich

[57] ABSTRACT

A splashguard and support accessary for a toothbrush available in six shapes being constructed as one piece of injected molded flexable plastic with a central aperture passing therethrough. A support collar is molded into the guard surrounding the aperture on both surfaces thereby yielding greated stability of position for the guard when placed onto the toothbrush handle. The guard is easily installed onto the toothrush by wetting the handle with water then aligning the aperture and pressing the guard over the bottom end of the toothbrush handle and sliding the guard forward to the neck area approximately 1½ inches below the bristles. The guard when properly positioned prevents toothpaste dentifrice from running down onto the handle; prohibits people from swallowing the toothbrush or gagging; suspends the toothbrush in the air so the bristles will not touch a counter top nor a toothbrush rack. An option within the the present invention is to fill in the collar area with a membrane and place a small rectangular aperture therein. Hygiene is the priority of the present invention.

17 Claims, 13 Drawing Sheets

FIG. 10(a)
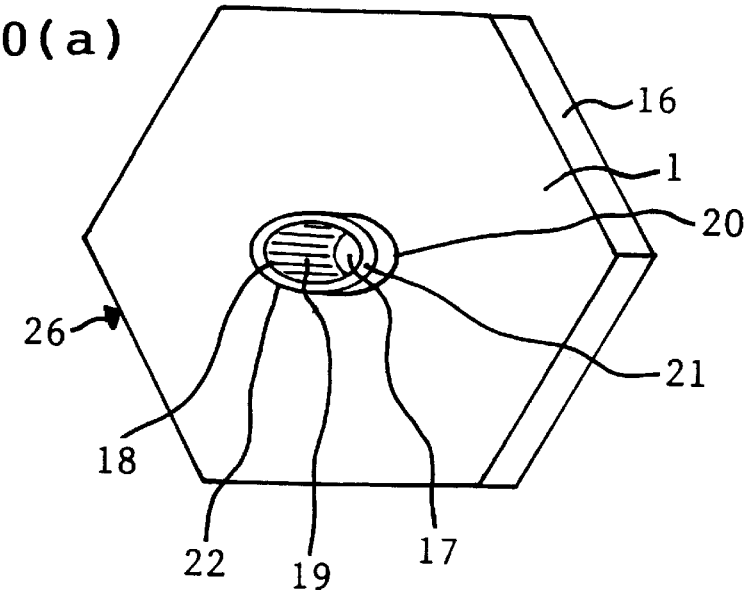
FIG. 10(b)
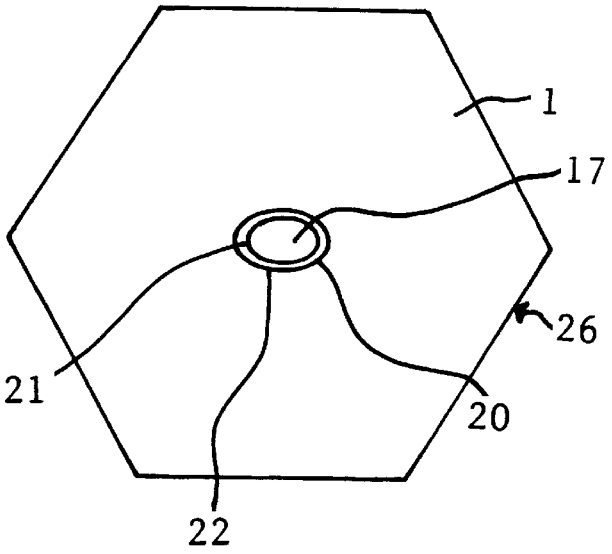
FIG. 10(c)
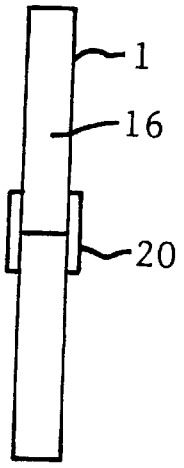
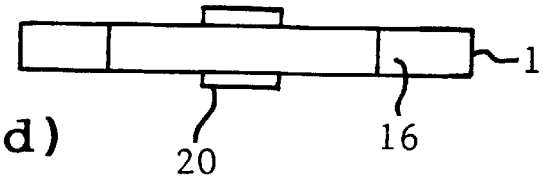
FIG. 10(d)

FIG. 15(a)
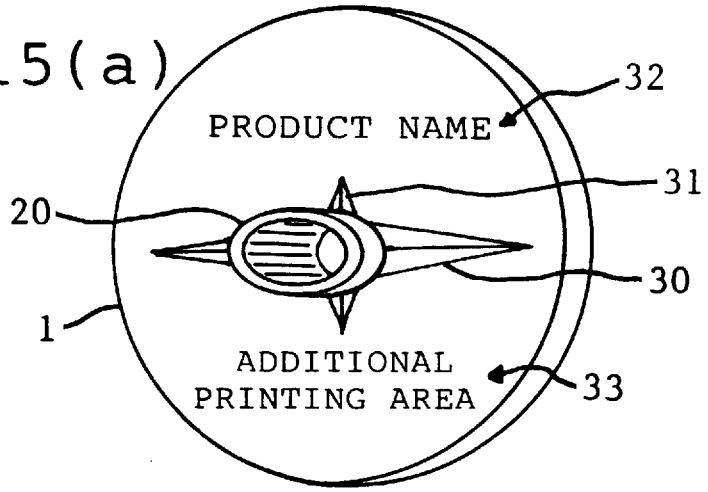
FIG. 15(b)
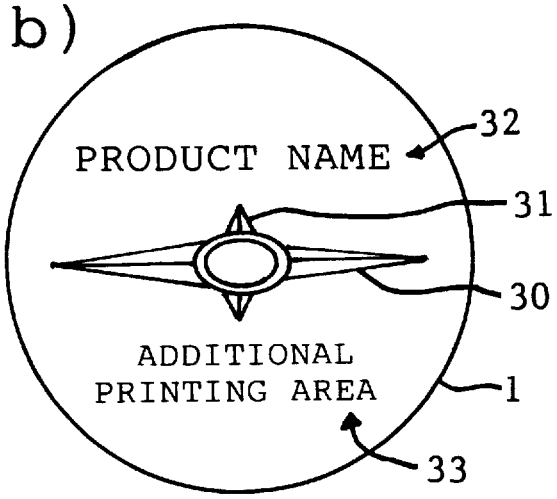
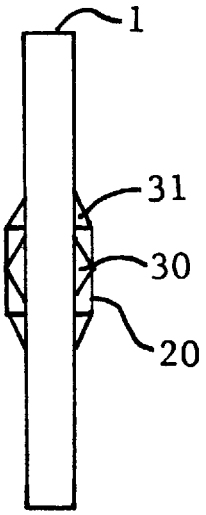
FIG. 15(c)
FIG. 15(d)
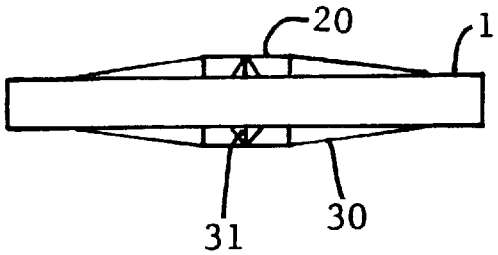

ACCESSORY FOR A TOOTHBRUSH

BACKGROUND OF THE INVENTION

The field of the present invention is an accessory for a toothbrush namely a splashguard and support.

In U.S. Pat. No. 3,968,950 Gallo shows a combination support and guard for a toothbrush. The device has a front and back surface area with an aperture passing therethrough. In order to make the invention functional a second part is necessary. An adapter is designed to wedge slide into the aperture of the guard. Any downward motion of the guard would dislodge the guard from the adapter. This design is ackward and good in theory only. The guard aperture is not yieldable. The adapter is. It is the object of the present invention to provide a simpler and more effective guard for a toothbrush than that shown in the aforementioned U.S. Pat. No. 3,968,950.

SUMMARY OF THE INVENTION

As herein illustrated the present invention is a single piece injection molded piece of flexible plastic. With a built-in elastic memory. Namely a low density polyurethane such as used in baby pacifiers. An aperture is located in the center of the guard with a support collar molded into each surface surrounding the outside edge of the aperture. This yields greater stability of position for the guard when placed on the toothbrush handle. This design is simple and easy to install. One size aperture fits onto just about any size handle because of the flexible plastic used with built-in elastic memory. The installation of the guard onto the handle of the toothbrush is made easier by wetting the handle with water.

The preferred aperture is ellipse shaped so as to make it easy to install the handle therethrough yet yield a sufficient gripping surface for any size toothbrush handle.

The inside surface of the aperture and collar are smooth for ease of installation.

To further aid with stability the thickness of the guard is approximately ⅛ of an inch. The collars are each approximately 1/16 of an inch. This makes for an overall aperture having a finished entrance to exit inside surface length of approximately 4/16 of an inch. These measurements have worked well with the functional protype.

The diameter of the guard is approximately 2 inches. This varies with the shape.

Both the collars apertures and the guard aperture are expandable to fit onto the toothbrush.

Preferred is an ellipse shape aperture. Both collar apertures align with the guard aperture.

Either side of the guard may be used as an entrance with the opposite side being the exit.

The preferred resting position for the guard on the toothbrush handle is approximately 1½ inches below the bottom of the bristles.

Both collars protrude away from the surface of the guard approximately 1/16 of an inch.

The guard may come to rest on any edge and still preform its functions No matter which shape is selected.

One size aperture fits onto most toothbrushes. The built-in memory of the plastic material allows the flexability the accommodate the various size toothbrush handles. Both the guard aperture and the collar apertures are the same size. Preferred is approximately ⅜ of an inch in diameter and approximately ¼ of an inch high in the center.

The guard has six shapes available: round, square, ellipse, pentagon, hexagon and star. A different shape for each member of the family. Also available is glow in the dark green and red along with gold and rainbow sparkle. The guard when injected molded of plastic can easily be any color or combination. Preferred is opaque white or a full color spectrum.

Either flat surface can have the product or a company name engraved into the mold thereby appearing on the molded surface of the guard, The present invention will now be described further within the following drawings.

(*b*) is a front view of the round shaped guard. The backside being the mirror image.

(*c*) is a top view of the round shaped guard. The bottom and both sides being the mirror image.

Figure 8A:
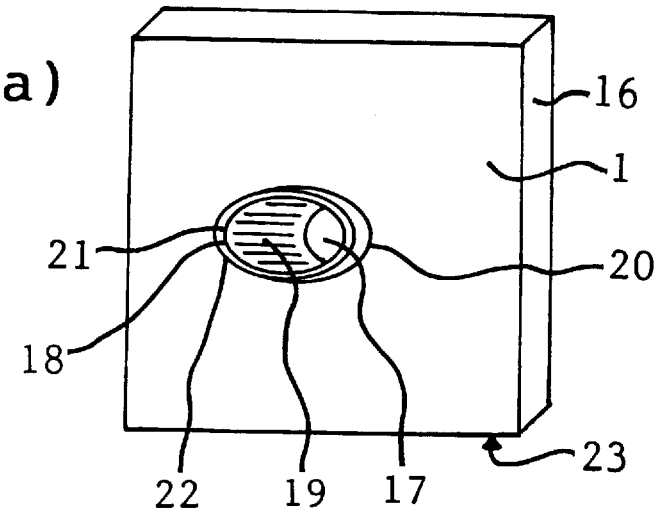
Figure 8B:
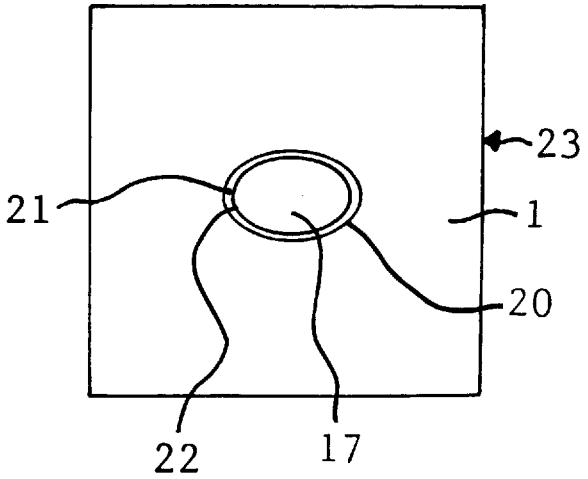
Figure 8C:
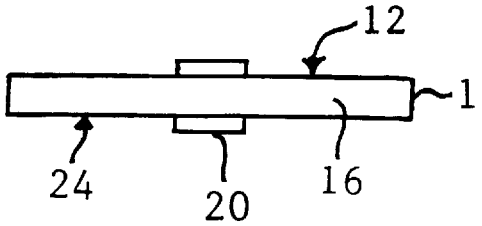
Figure 9A:
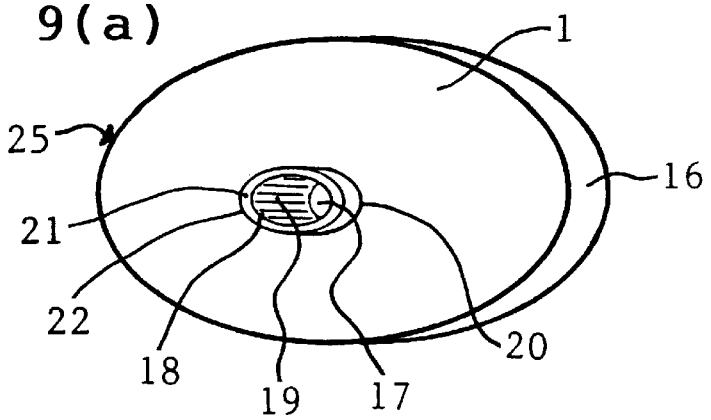
Figure 9B:
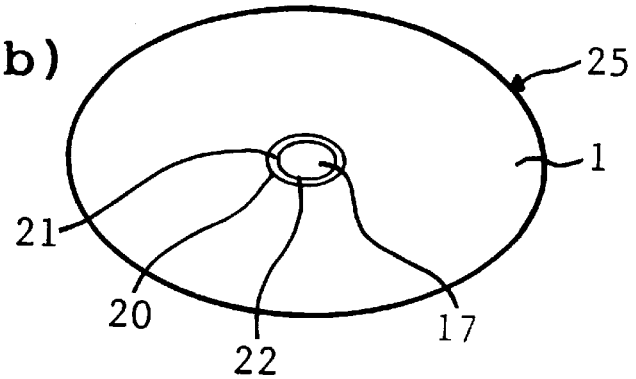
Figure 9C:
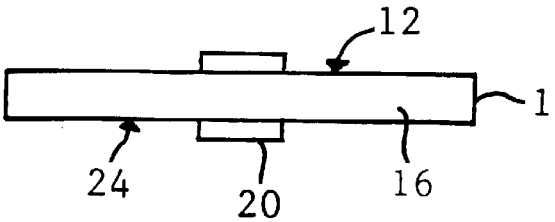
Figure 9D:
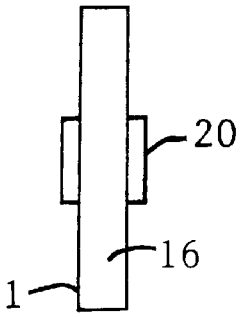
Figure 11A:
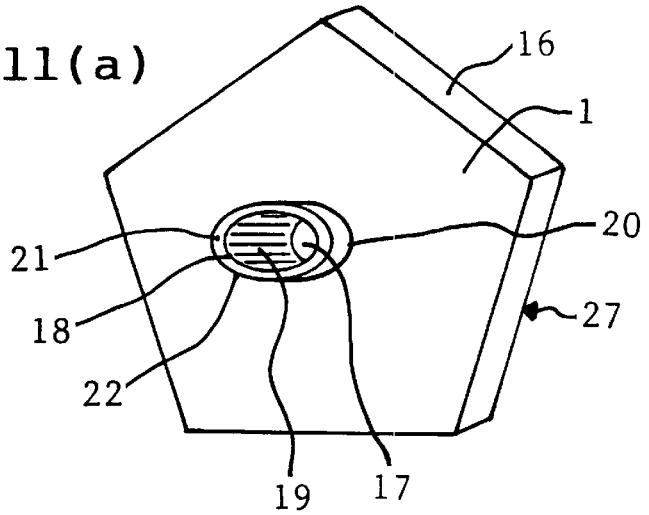
Figure 11B:
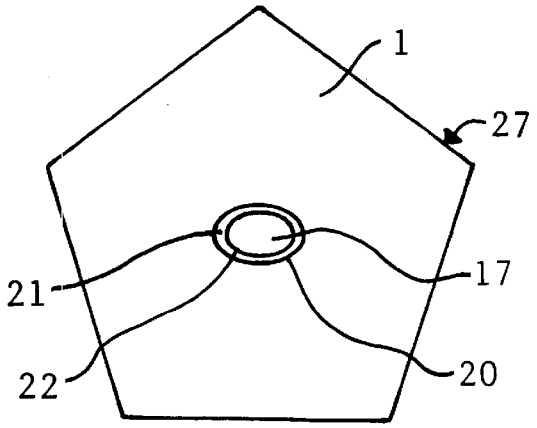
Figure 11C:
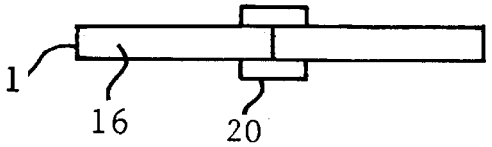
Figure 11D:
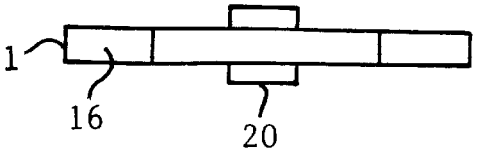
Figure 11E:
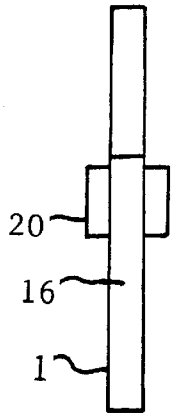
Figure 12A:
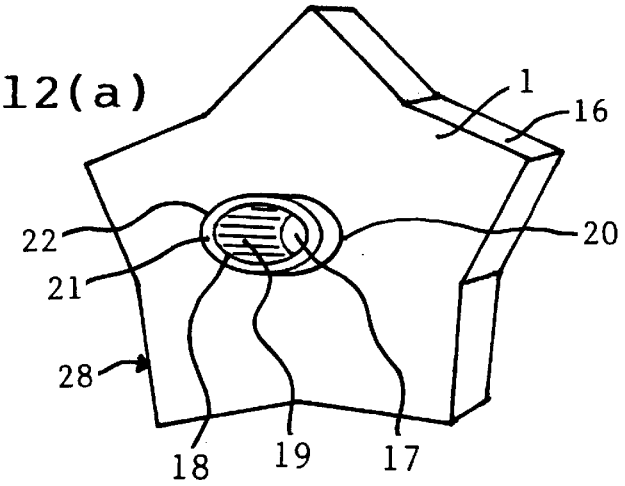
Figure 12B:
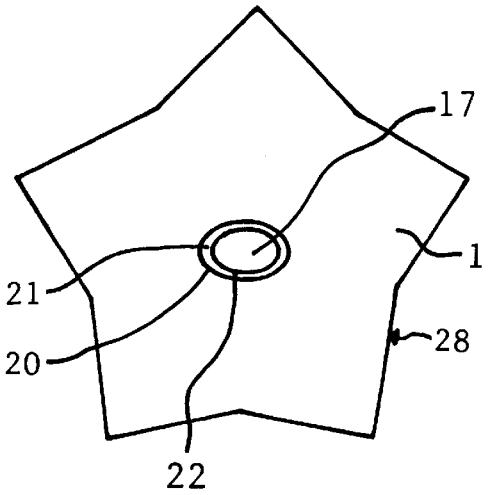
Figure 12C:
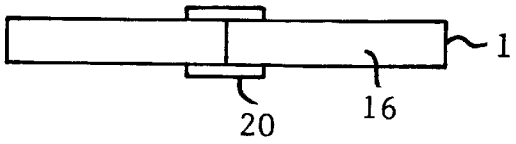
Figure 12E:
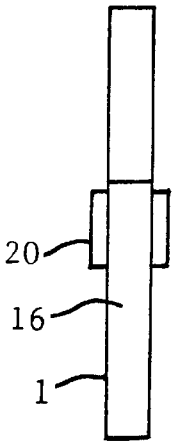
Figure 12D:
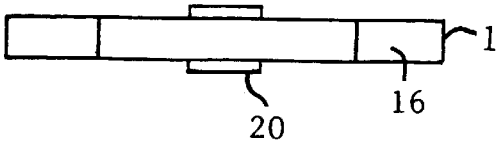

FIGS. 8(*a*) is a perspective view of a square shaped guard.

(*b*) is a front view of the square shaped guard. The back being the mirror image.

(*c*) is a top view of the square shaped guard. The bottom and both sides being the mirror image.

FIGS. 9(*a*) is a perspective view of an ellipse shaped guard.

(*b*) is a front view of the ellipse shaped guard. The back being the mirror image.

(*c*) is a side view of the ellipse shaped guard. The opposite side being the mirror image.

(*d*) is a top view of the ellipse shaped guard. The bottom being the mirror image.

FIGS. 10(*a*) is a perspective view of a hexagon shaped guard.

(*b*) is a front view of the hexagon shaped guard. The back being the mirror image.

(*c*) is a side view of the hexagon shaped guard. The opposite side being the mirror image.

(*d*) is a top view of the hexagon shaped guard. The bottom being the mirror image.

FIGS. 11(*a*) is a perspective view of a pentagon shaped guard.

(*b*) is a front view of the pentagon shaped guard. The back being the mirror image.

(*c*) is a top view of the pentagon shaped guard, (*d*) is a bottom view of the pentagon shaped guard.

(*e*) is a side view of the pentagon shaped guard. The opposite side being the mirror image.

FIGS. 12(*a*) is a perspective view of a star shaped guard.

(*b*) is a front view of the star shaped guard. The opposite side being the mirror image.

(*c*) is a top view of the star shaped guard.

(*d*) is a bottom view of the star shaped guard.

(*e*) is aside view of the star shaped guard. The opposite side being the mirror image.

Figure 13A:
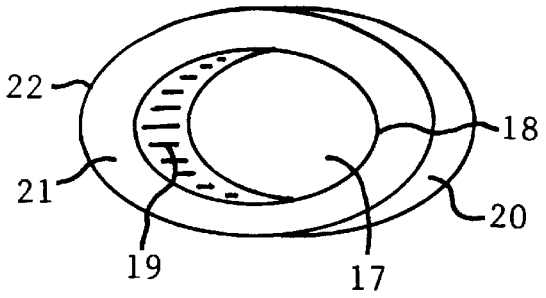
Figure 13B:
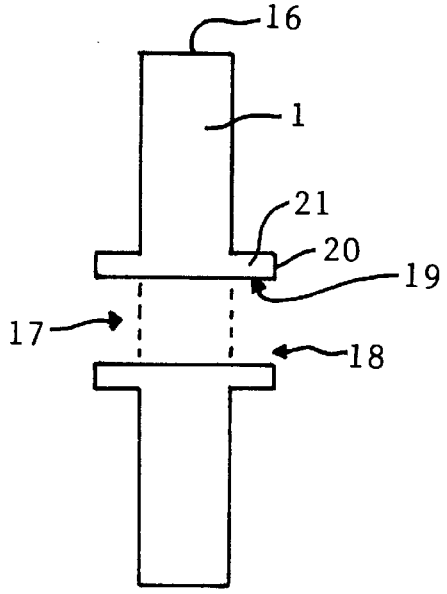
Figure 13C:
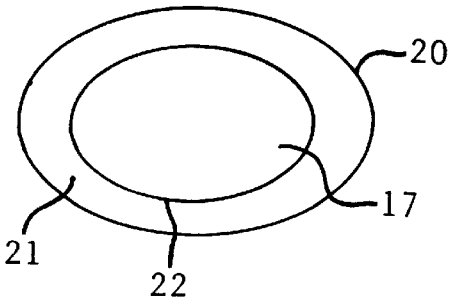

FIGS. 13(*a*) is an enlarged perspective view of the support collar with aperture.

(*b*) is a cross section view of both support collars and the guard.

(*c*) is an enlarged front view of the support collar with aperture.

Figure 14A:
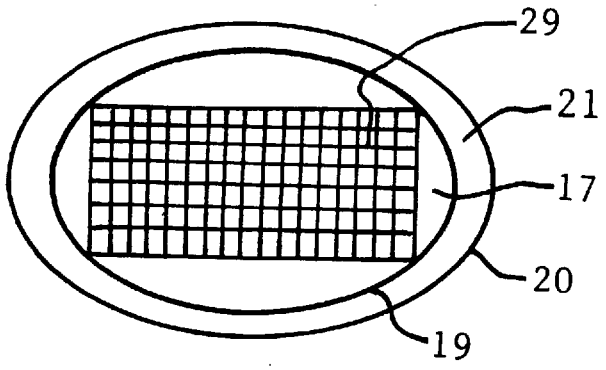
Figure 14B:
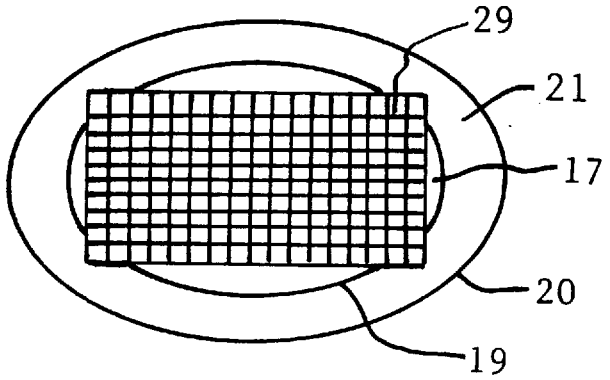
Figure 14C:
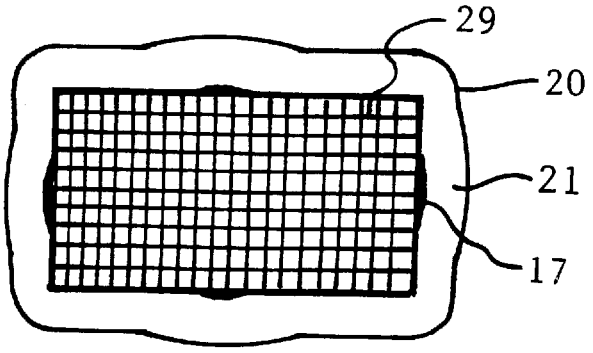

FIGS. 14(*a*) is a cross section view of a small diameter toothbrush handle positioned inside the aperture of the guard.

(*b*) is a cross section view of a medium diameter toothbrush handle positioned inside the aperture of the guard.

(*c*) is a cross section view of a large diameter toothbrush handle positioned inside the aperture of the guard.

FIGS. 15(*a*) is a perspective view of the guard showing the positions of the optional gusset supports.

(*b*) is a front view showing the positions of the optional gusset supports; the back side being the mirror image.

(*c*) is a side view showing the positions of the optional gusset supports; the opposite side being the mirror image.

(*d*) is a top view showing the position of the optional gusset supports; the bottom being the mirror image.

Figure 16A:
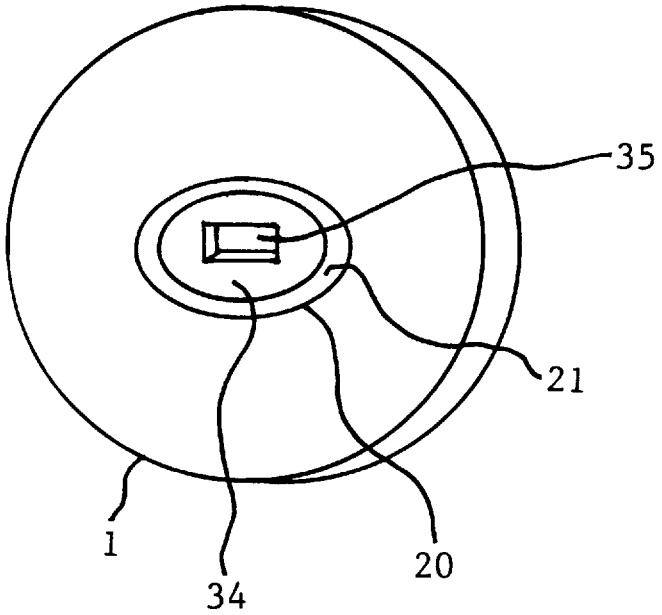
Figure 16B:
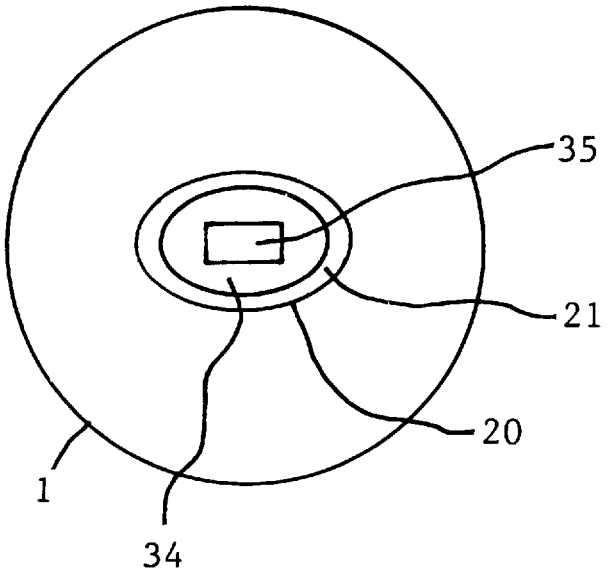

FIGS. 16(*a*) is a perspective view of the guard with membrane and aperture.

(*b*) is a flat view of the guard with membrane and aperture.

DESCRIPTION OF THE PREFERRED EMBODIMENT

Figure 1:
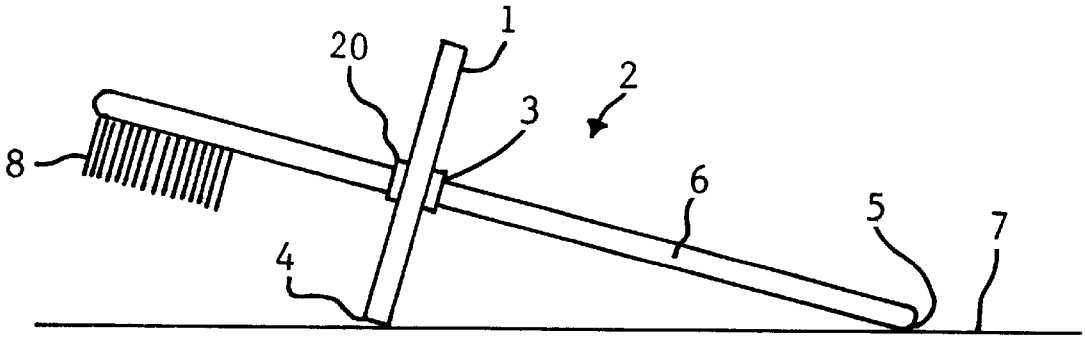
FIG. 1 is an elevation view of the guard resting on its edge while correctly positioned thereon a toothbrush.

FIG. 1 is a view of the splashguard & support guard 1 on a toothbrush 2 in the correct position 3. The bottom edge 4 of the guard 1 and the bottom tip 5 of the toothbrush handle 6 both rest on a counter top 7. As one can see with the guard 1 in the correct position 3 on toothbrush 2 the bristles 8 are well above the surface of the counter top 7. This resting position for the toothbrush 2 allows the bristles 8 to breath and excess moisture to drip off bristles 8.

Figure 2:
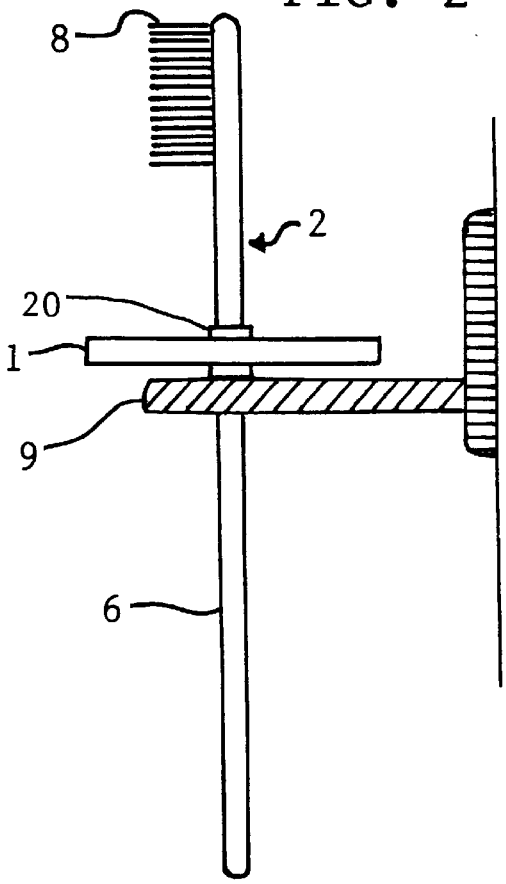
FIG. 2 is an elevation view of the guard resting on its bottom side being suspended by a wall mounted toothbrush rack.

In FIG. 2 the toothbrush 2 with handle 6 and bristles 8 is shown with guard 1 and support collars 20 being suspended in a virtical position by toothbrush wall rack 9. Again as in FIG. 1 the bristles 8 are allowed to breath and excess moisture can drain off the bristles 8.

Figure 3:
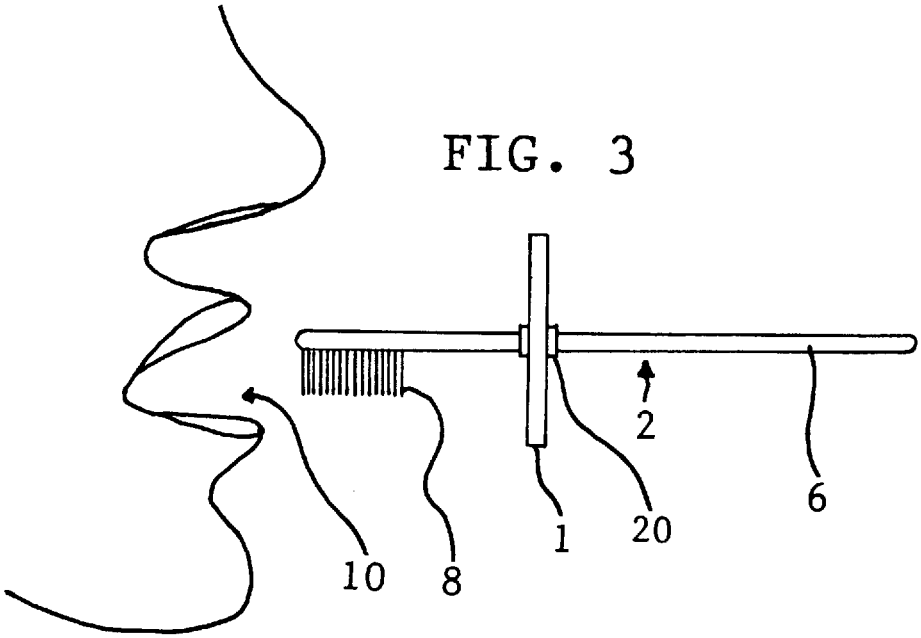
FIG. 3 is a view of a toothbrush, with the guard thereon, shown entering the users mouth.

In FIG. 3 the toothbrush 2 with handle 6 , bristles 8 and guard 1 with support collars 20 thereon is shown approaching the users mouth 10. The guard 1 is wide enough so the user can not swallow the brush 2. The position of the guard 1 on the brush 2 prohibits the brush 2 from entering the mouth to the throat area. Therefor gagging or choking is prohibited. The bristles 8 enter the mouth just far enough to enable cleaning all the users teeth.

Figure 4:
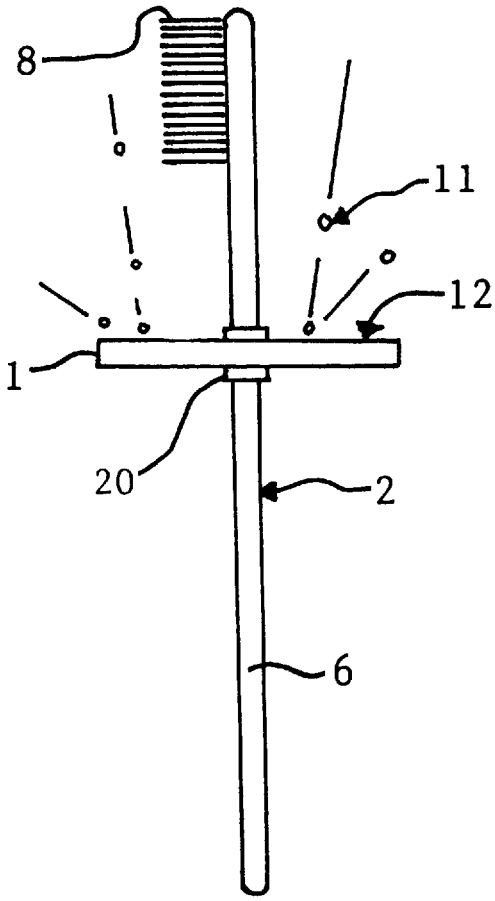
FIG. 4 is an elevation view of a toothbrush,with guard thereon,showing dentifrice and water droplets bouncing off the upper surface of the guard.

In FIG. 4 the toothbrush 2 with guard 1 thereon is shown with water/dentifrice droplets 11 bouncing off the guard 1 top surface 12. Also shown are bristles 8, collars 20 and handle 6.

Figure 5:
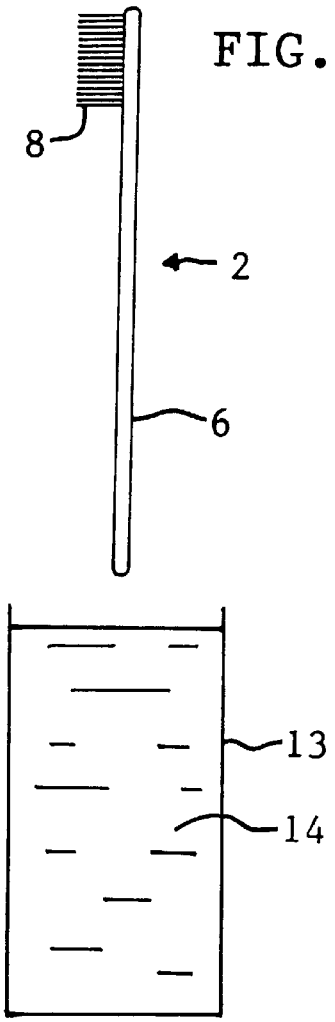
FIG. 5 is a drawing of a glass of water with the handle of the toothbrush ready to be dipped therein the water.

FIG. 5 is a view of a toothbrush 2 and bristles 8 with handle 6 ready to be dipped in a glass 13 with water 14. Simply holded the handle under under the water tap would also do the job.

Figure 6:
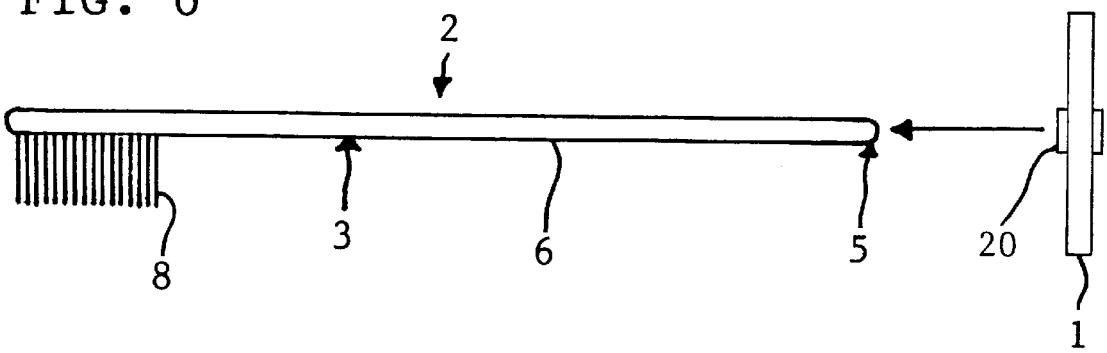
FIG. 6 is a view of a toothbrush showing the guard in position ready to be placed thereon the brush handle.

FIG. 6 is a view of the guard 1 with support collars 20 in position to be placed onto the bottom end 5 of toothbrush 2. The correct resting position 3 for guard 1 is shown on toothbrush 2 handle 6 with bristles 8. Dip or wet the handle 6 with water and align guard 1 onto handle 6 at bottom end 5. Slide guard 1 to the correct resting position 3 on brush 2. The toothbrush handle 6 at bottom end 5 aligns with collar 20. Thereafter handle 6 passes through the guard 1 and exits on the opposite side through opposite collar 20.

Figure 7A:
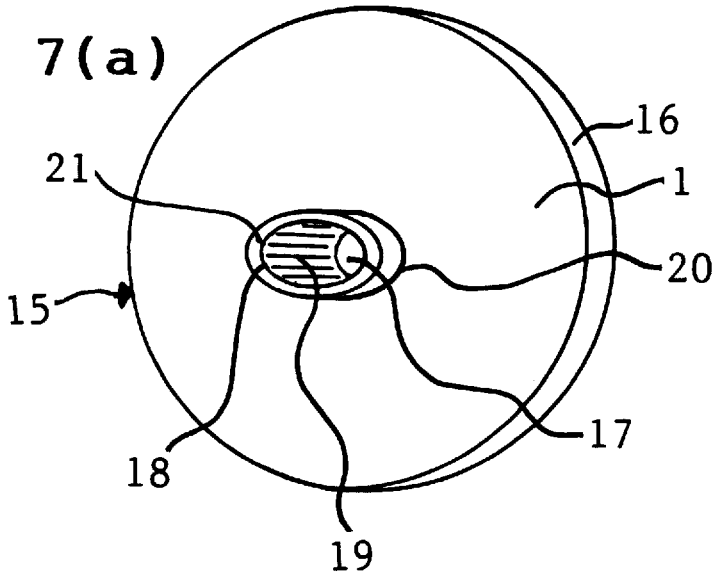
FIGS. 7(*a*) is a perspective view of a round shaped guard.
Figure 7B:
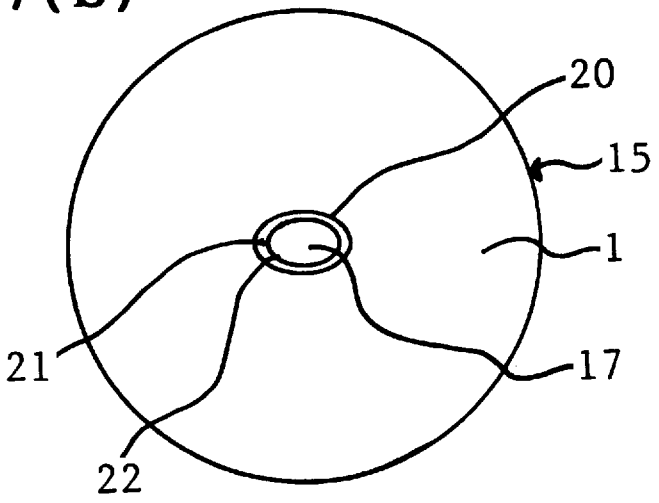
Figure 7C:
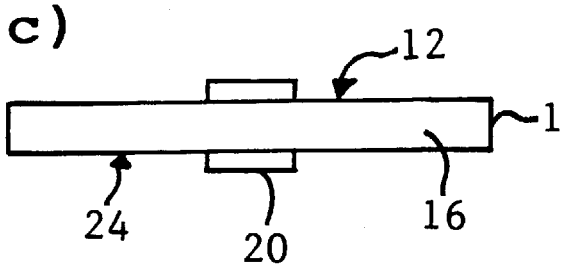

FIG. 7(*a*) is a perspective view of a round 15 shaped guard 1 showing the thickness 16 of guard 1. An aperture 17 with entrance 18 and inside aperture surface 19 is shown on the support collar 20 with collar thickness 21. FIG. 7(*b*) is a front view of round 15 shaped guard 1 with aperture 17 with ellipse shape 22 aperture on support collar 20 and collar thickness 21 located in the center of guard 1. The back side of the round 15 shaped guard 1 is the mirror image. FIG. 7(*c*) is a top view of guard 1 with guard thickness 16 and support collars 20 on top surface 12 and bottom surface 24. In the round shaped model the bottom and both sides are the mirror image of the top view. In the case of the round guard model the toothbrush can be laid on a counter top on any edge because the roundness will seek its own resting place. The priority or preferred position for best hygiene on a counter top is to have the bristles face downward. This position allows the excess moisture to readily drain away. When the bristles point upwards there is a better chance for excess moisture to collect between the bristles especially at the bottom where the bristles attach to the brush head. The back side of the head of the brush, opposite the bristles, is a protection factor for the bristles. Nothing can collect onto the bristles with them pointing downwards.

FIG. 8(*a*) is a perspective view of a square 23 shaped guard 1 showing the guard thickness 16 of guard 1. An aperture 17 with entrance 18 and inside aperture surface 19 is shown on the support collar 20 with collar thickness 21. FIG. 8(*b*) is a front view of square 23 shaped guard 1 with with aperture 17 with ellipse shape 22 aperture 17 on support collar 20 with collar thickness 21 located in the center of guard 1. The back side of square 23 shaped guard 1 is the mirror image. FIG. 8(*c*) is a top view of guard 1 with thickness 16 and support collars 20 on top guard surface 12 and bottom guard surface 24. In the square shaped model the bottom and both sides are the mirror image of the top view.

FIG. 9(*a*) is a perspective view of an ellipse 25 shaped guard 1 showing the guard thickness 16 of guard 1. An aperture 17 with entrance 18 and inside aperture surface 19 is shown on the support collar 20 with collar thickness 21. FIG. 9(*b*) is a front view of ellipse 25 shaped guard 1 with aperture 17 with ellipse shape aperture 22 on support collar 20 with collar thickness 21 located in the center of guard 1. The back view of guard 1 being the mirror image of the front view. FIG. 9(*c*) is a top view of guard 1 with guard thickness 16 and support collars 20 on top guard surface 12 and bottom surface 24. In the ellipse shaped model the bottom view is the mirror image. In FIG. 9(*d*) the guard 1 is shown in a side view with thickness 16 and support collars 20 on each surface. The opposite side view is the mirror image.

FIG. 10(*a*) is a perspective view of a hexagon 26 shaped guard 1 showing the guard thickness 16 of guard 1. An aperture 17 with entrance 18 and inside aperture thickness 19 is shown on the support collar 20 with collar thickness 21. FIG. 10(*b*) is a front view of hexagon 26 shaped guard 1 with aperture 17 with ellipse shape aperture 22 on support collar 20 with collar thickness 21 located in the center of guard 1. The back view of guard 1 being the mirror image of the front view. FIG. 10(*c*) is a side view of guard 1 with guard thickness 16 and support collars 20. The opposite side being the mirror image. FIG. 10(*d*) is a top view of guard 1 with guard thickness 16 and support collars 20. The bottom being the mirror image.

FIG. 11(*a*) is a perspective view of a pentagon 27 shaped guard 1 showing the guard thickness 16 of guard 1. An aperture 17 with entrance 18 and inside aperture thickness 19 is shown on the support collar 20 with collar thickness 21. FIG. 11(*b*) is a front view of pentagon 27 shaped guard 1 with aperture 17 with ellipse shape aperture 22 on support collar 20 with collar thickness 21 located in the center of guard 1. The back being the mirror image. FIG. 11(*c*) is a top view of guard 1 with guard thickness 16 and support collar 20. In FIG. 11(*d*) the guard 1 is shown in a bottom view with guard 1 guard thickness 16 and support collars 20. FIG. 11(*e*) is a side view showing the guard 1 with guard thickness 16 and support collars 20. The opposite side being the mirror image.

FIG. 12(*a*) is a perspective view of a star 28 shaped guard 1 showing the guard thickness 16 of guard 1. An aperture 17 with entrance 18 and inside aperture thickness 19 is shown on the support collar 20 with collar thickness 21. FIG. 12(*b*) is a front view of star 28 shaped guard 1 with aperture 17 with ellipse shape aperture 22 on support collar 20 with collar thickness 21 located in the center of guard 1. The back being the mirror image. FIG. 12(*c*) is a top view of guard 1 with guard thickness 16 and support collar 20. In FIG. 12(*d*) the guard 1 is shown in a bottom view with guard 1 guard thickness 16 and support collars 20. FIG. 12(*e*) is a side view showing the guard 1 with guard thickness 16 and support collars 20. The opposite side being the mirror image.

FIG. 13(*a*) is an enlarged perspective view of the support collar 20 with aperture 17 aperture entrance 18 inside aperture surface 19 and collar thickness 21 with the selected ellipse shape 22 for the aperture 17. The distance of the support collar 20 from the outer edge to the point where it is attached to the guard is approximately 1/16 of an inch. The inside aperture surface 19 has a total length of 4/16 or 1/4 of an inch. This is better shown in FIG. 13(*b*) a cross section side view wherein section A, the front support collar is shown in dotted lines, is approximately 1/16 of an inch; then section B the collar in dotted lines, is approximately 1/8 of an inch. The opposite or back support collar in section C is also shown in dotted lines. Being approximately 1/16 of an inch. FIG. 13(*c*) is a front enlarged view of the support collar 20 with aperture 17 ellipse shaped aperture 22 and support collar thickness 21.

FIG. 14(*a*) shows a front cross sectional view of the guard 1 with aperture 17 support collar thickness 21 and ellipse shape aperture 22. Inside the aperture 17 is a cross section of a small toothbrush handle 29. As seen in the drawing FIG. 14(*a*) the small toothbrush handle 29 touches the inside surface 19 of guard 1 in four places. This is sufficient for a small cross section toothbrush. FIG. 14(*b*) shows a medium diameter handle while FIG. 14(*c*) shows a large diameter handle. The larger the handle the tighter the fit.

In FIG. 15(*a*) the guard 1 is shown in a perspective view with support collar 20. On either horizontal side of support collar 20 is a horizontal gusset 30 which is engraved into the production mold. From the top and bottom of support collar 20 are shorter vertical gussets 31. The reason for the shortness of gusset 31 is so that they will not interfere with the product name 32 engraving area. This leaves a smooth surface for hot stamping also.

In FIG. 15(*b*) the guard 1 is shown with support collar 20, horizontal gusset 30, vertical gusset 31, engraving product name area 32 and additional printing area 33.

In FIG. 15(*c*) a side view is shown with guard 1 , collars 20, short vertical gusset 30 and long horizontal gusset 31. The opposite side being the mirror image.

In FIG. 15(*d*) the guard 1 is shown as a top view with collars 20, long horizontal gusset 30 and short vertical gusset 31. The bottom being the mirror image.

The gussets shown in FIGS. 15(*a*), (*b*), (*c*) and (*d*) are optional. If the decision is made to lesson the thickness of the guard say to 1/16 of an inch instead of 1/8 of an inch, then the gussets will help to strengthen the guard from flopping too much. The gussets are not drawn into the various shapes of the guard because they are optional if needed.

The present invention discloses an ellipse shape aperture as a distinct feature of the preferred design. This ellipse shaped aperture is only one manufactured size which fits most toothbrush handles. The preferred aperture size is approximately 3/8 of an inch wide. After experimenting with over 30 different toothbrush cross handle sizes it was decided that the 3/8 of an inch is a good mean size. The height of the ellipse aperture is 1/4 of an inch. A round or rectangular shaped aperture does work as does a square aperture. The best shape turned out to be ellipse. As seen in the FIGS. 14(*a*), (*b*) and (*c*) drawings three different size cross section handles fit and graphold best with the ellipse shaped aperture. Sufficient surface area made for better and more gripping surface. While the low density polyurethane plastic had sufficient elastic memory or flexibility to accept and retain most size handles.

Notice in the FIGS. 14(*a*), (*b*) and (*c*) drawings that the larger the handle the more contact the toothbrush handle had with the inside of the guard and the support collars.

Within the scope of the present invention also herein disclosed is an optional aperture assembly. In FIG. 16(*a*) the perspective view reveals a smaller rectangular aperture within a surrounding membrane which is confined to the ellipse shaped collar area. This option may turnout to be included in the preferred art. R. & D. has not been started yet but the theory is herein disclosed so as to be easily included within the scope of the present invention.

FIG. 16(*b*) is a perspective view of the guard 1 with collar 20, collar wall thickness 21, membrane/skirt 34 and membrane aperture 35. The preferred membrane aperture size and shape is one eigth of an inch high and one quarter of an inch wide and rectangular shaped with inside rounded corners so as not to tear.

The idea here is to fill in the aperture area shown in FIG. 7 drawings with a membrane/skirt and place a smaller aperture in the membrane itself. This art may make it necessary to make the collared area larger so as to accomodate the membrane/skirt and still leave sufficient room for the membrane aperature. This art, if it turns out to be the preferred art, would be an option to the art disclosed in the beginning portion of the present invention.

The membrane would be thinner than the guard. Therefor the distortion of placing various diameter toothbrush handles would stay within the membrane material. The collar size and wall thickness will stay the same and act as a support barrier surrounding the membrane area.

The guard thickness stays the same. But the membrane thickness is preferred to be less than the guard thickness. This membrane and membrane aperture will still work with no matter what shape the guard is. Be it square, hexagon or star etc.

This optional art does not change the fact that the guard will be in several shapes. The membrane/skirt with membrane aperture is the only change.

Further in the present invention is disclosed a bristles cover which is attached to and stablized by the guard itself.

This accessary is a protective cover for the bristles. Keeping the bristles clean while having holes therein the cover will aerate. The cover encapsulates the head of the toothbrush and is attached to the guard. The cover does not work without the guard. The guard supports the cover.

Still further disclosed in the present invention is a carrying case for the toothbrush with the guard thereon. The guard can be either positioned on the brush or have a seperate compartment. The case is a clam shell style which opens on one side and hinges from the opposite side.

The storage case is especially constructed of plastic with aeration holes in the container at the bristle end. This allows the bristles to dry off and breath. Also the case prohibits dirt from contacting the bristle area. The guard of the invention is already positioned on the brush as one piece. An optional style would be a case that is built to contain the brush in one cavity and the guard in a seperate cavity.

Further, within the scope of the present invention is the option of a smaller guard for children size tootbrushes. The full color spectrum, glow-in-the dark etc. is also included. The guard may be tooth shaped or the like.

It is hereby understood that the aforementioned detailed forms of the preferred embodiment of the invention is not to be limited to the exact arrangement but are examples only. The arrangement of the styles shown in the drawings or described in the disclosure may be modified without departing from the true spirit and scope on the invention. The details of the various shapes, sizes, materials and functions of the guard of the invention are of novel concept thereof.

Having thus described the invention with an exclusive property or privilege:

What I claim is:

1. A dental hygiene device comprising, in combination:

(a) a toothbrush comprising a handle having a plurility of bristles secured to a head portion thereof, and (b) a splashguard and support attachment for said toothbrush, said attachment comprising a flat shield member having first and second opposite planar side surfaces, said shield member having an aperture extending through a central portion thereof, said shield member having a thickness and a perpheral edge;

a first and second support collar extending from the first and second respective side surfaces of the shield member, said support collars having apertures aligned with the aperture in the shield member;

at least one elongated support gusset formed on each of the side surfaces of the shield member, said support gussets each having a first end adjacent the respective support collar and a second end extending toward the peripheral edge of the shield member, said support gussets adding a degree of strength to the shield member;

said support collars and said flat shield member being made of a soft and flexible material having a degree of elastic memory whereby various toothbrush handle sizes are adapted to be received within said aperture; and wherein said shield member is adapted to be slidably received on the handle of said toothbrush at a predetermined location thereon, at which point the shield member acts as both a splash guard as well as a means for supporting the toothbrush on a flat surface.

2. The invention of claim 1 wherein said attachment is made of an injection molded material selected from the group consisting of P.V.C. (polyvinylchloride) and rubber T.P.R. (thermal plastic rubber), said material having a durometer ranging from 20 to 120.

3. The invention of claim 1 wherein the peripheral edge of the shield member has a shape selected from the group consisting of round, square, pentagon, hexagon, ellispe, star and tooth, said thickness ranging from 0.020 to 0.480 inch and said shield member having a diameter ranging from one-half to three inches.

4. The invention of claim 1 wherein said, support collars have a shape selected from the group consisting of square, round, rectangular and ellipse; said collars have a wall thickness ranging from 0.010 to 0.100 inch and said collars have a height projected away from the respective side surface ranging from 0.010 to 0.100 inch.

5. The invention as claimed in claim 1 wherein said aperture shape is selected from the group consisting of round, square, rectangular and ellipse; said aperture have a diameter ranging from one quarter to three quarters of an inch and a height ranging from one sixteenth to one half an inch; said apertures have a depth of approximately three sixteenth of an inch.

6. The invention as claimed in claim 1 wherein said pre-determined location is approximately one and one half inches below the bottom of said bristles thereby yielding support in a angle of 5 to 90 degrees above said flat surface.

7. The invention as claimed in claim 1 wherein said handle may be installed from either side surface of said shield member.

8. The invention as claimed in claim 1 wherein said attechment has a pre-determined sequence of installation beginning with mounting from the bottom of the handle of said toothbrush and sliding up the handle to the predetermined location thereon, said device solves problems from the group consisting of preventing toothpaste from running downwards on the handle; the bristles of said toothbrush from touching a counter top or toothbrush rack and the user from gagging or swallowing said toothbrush.

9. A dental hygiene device comprising, in combination:

(a) a toothbrush comprising a handle having a plurality of bristles secured to a head portion thereof; and (b) a splashguard and support attachment for said toothbrush, said attachment comprising a flat shield member having first and second opposite planar side surfaces, said shield member having an aperture extending through a central portion thereof, said shield member having a thickness and a peripheral edge;

a first and second support collar extending from the first and second respective side surfaces of the shield member, said support collars having apertures aligned with the aperture in the shield member;

a flexible membrane located within the aperture in the shield member, said flexible membrane having an aperture extending therethrough and a thickness, the aperture in the flexible membrane being substantially located within the aperture in the shield member, the thickness of the flexible membrane being less than the thickness of the shield member;

said support collars, flexible membrane and said flat shield member being made of a soft and flexible material having a degree of elastic memory whereby various toothbrush handle sizes are adapted to be received within the aperture in the flexible membrane; and wherein said shield member is adapted to be slidably received on the handle of said toothbrush at a predetermined location thereon, at which point the shield member acts as both a splashguard as well as a means for supporting the toothbrush on a flat surface.

10. The invention of claim 9 wherein said attechment is made of an injection molded material selected from the group consisting of P.V.C. (polyvinylchioride) and rubber T.P.R. (thermal plastic rubber), said material having a durometer ranging from 20 to 120.

11. The invention of claim 9 wherein the peripheral edge of the shield member has a shape selected from the group consisting of round, square, pentagon, hexagon, ellispe, star and tooth, said thickness ranging from 0.020 to 0.480 inch and said shield member having a diameter ranging from one-half to three inches.

12. The invention of claim 9 wherein said support collars have a shape selected from the group consisting of square, round, rectangular and ellipe; said collars have a wall thickness ranging from 0.010 to 0.100 inch and said collars have a height projected away from the respective side surface ranging from 0.010 to 0.100 inch.

13. The invention of claim 9 wherein said aperture shape is selected from the group consisting of round, square, rectangular and ellispe; said apertures have a diameter ranging from one quarter to three quarters of an inch and a height ranging from one sixteenth to one half an inch; said apertures have a depth of approximately three sixteenth of an inch.

14. The invention of claim 9 wherein said pre-determined location is approximately one and one half inches below the bottom of bristles thereby yielding support in a angle of 5 to 90 degrees above said flat surface.

15. The invention of claim 9 wherein said handle may be installed from either side surface of said shield member.

16. The invention of claim 9 wherein said attechment has a pre-determined sequence of installation beginning with mounting from the bottom of the handle of said toothbrush and sliding up the handle to the pre-determined location thereon, said device solves problems from the group consisting of preventing toothpaste from running downwards on the handle; the bristles of said toothbrush from touching a counter top of toothbrush rack and the user from gagging or swallowing said toothbrush.

17. The invention as claimed in claims 1 or 9 wherein said attachment may be scaled down in size so as to accommodate installation on any size children's toothbrush.

* * * * *